US005908230A

United States Patent [19]

Duell et al.

[11] Patent Number: 5,908,230

[45] Date of Patent: Jun. 1, 1999

[54] LIGHT EMITTING APPLIANCE BULB MOUNT

[75] Inventors: Richard J. Duell; Stephen Stopyra, both of Syracuse; Theodore S. Bolton, Liverpool, all of N.Y.

[73] Assignee: Carrier Corporation, Farmington, Conn.

[21] Appl. No.: 09/017,346

[22] Filed: Feb. 2, 1998

[51] Int. Cl.[6] ..... F21V 33/00

[52] U.S. Cl. ..... 362/96; 362/89; 362/149; 362/377; 362/800

[58] Field of Search ..... 362/226, 89, 96, 362/253, 365, 377, 396, 800, 149

[56] References Cited

U.S. PATENT DOCUMENTS 5,217,292 6/1993 Chalberg ..... 362/96
5,848,839 12/1998 Savage, Jr. ..... 362/800 X

*Primary Examiner*—Stephen Husar
*Attorney, Agent, or Firm*—Wall Marjama Bilinski & Burr

[57] ABSTRACT

A bulb mounting for air handling equipment indicator bulbs that include at least a lamp base having a top flange. The mounting includes an air handling equipment support member having a hole, and retaining surface disposed a predetermined distance above an equipment support wall, that slidably receives the lamp base so that the flange rests on the retaining surface. The mounting further includes a top cover having an opening large enough to receive the bulb, and a tube shape that presses the flange against the retaining surface. The cover top side is disposed a predetermined distance above the flange, so that the bulb is positioned and secured a precise distance relative to the top of the cover and the equipment support wall. The equipment support member is sized so that the lamp base may also have a compressible peripheral surface that is slidably received by the equipment support member, and yet presses against the support member, further positioning and securing the bulb relative to the air handling equipment apparatus.

20 Claims, 4 Drawing Sheets

LIGHT EMITTING APPLIANCE BULB MOUNT

BACKGROUND AND SUMMARY OF THE INVENTION

This invention relates to an air handling equipment indicator bulb mounting, and in particular to a mounting that secures an equipment panel indicator bulb on the equipment, and precisely positions the bulb with respect to both the equipment structure and the equipment top cover, without special fastening equipment so that the bulb may be both easily urged on and urged off.

Most equipment indicator bulbs are retained within a control panel because the bulb has a lamp base that includes special retaining features, such as a locking tongue or ramp, that presses the base against a retaining panel. These prior art equipment mounts lockably install in panels and cannot be easily removed. Furthermore, these panel mounts impose a rigid and complex installation procedure within an appliance, and retain the lamp a fixed distance from the panel, providing little flexibility in the placement of both the bulb and the mounting panel.

It is an object of the present invention to provide an air handling equipment indicator bulb mount that accommodates a commercially available bulb, particularly a light emitting diode (LED), without any special bulb fastening features, and installs and de-installs easily, and without the use of any tools.

A further object of the present invention is to provide an indicator bulb mount that will accommodate and retain a bulb, and will also accommodate the bulb's electrical quick connect terminals.

A still further object of the present invention is to provide an equipment air handling top cover that includes a stop design to retain and position the bulb.

Another object of the present invention is to mount an indicator bulb on the air handling equipment a specific height relative to the top cover, and a top cover stop with a specific height relative to the top of the cover, so that the bulb is precisely positioned so that a user can readily observe the light emanating from the bulb, and yet that the bulb is protected from an environmental contact.

These and other objects of the present invention are attained by a bulb mounting that includes a lamp base having at least a top flange. The mounting includes a tube shaped air handling equipment support member having a hole and furthermore a retaining surface that is disposed a predetermined distance above the equipment support wall, that slidably receives the lamp base so that the flange rests on the retaining surface. The mounting further includes a top cover having an opening large enough to receive the bulb, and that presses the flange against the retaining surface. The cover top side is disposed a predetermined distance above the flange, so that the bulb is positioned and secured a precise distance relative to the top of the cover as well as the equipment support wall. The equipment support member is sized so that the lamp base may also have a compressible peripheral surface that is slidably received by the equipment support member, presses against the support member inner wall and thus retaining the bulb in a position relative to the air handling equipment apparatus.

An air handling equipment apparatus mounting and restraining device includes a lamp with a base that contains a radially expanded top flange, forming a lip, and a bulb mounted on the top of the base; a support member having a hole passing through it, that slidably receives the lamp base wherein the flange rests on a restraining surface support member, securing the lamp in the support member; and a top cover mounted over the support member top surface with an opening for receiving the bulb, wherein the top cover presses against the lamp flange, securing the flange against the retaining surface.

The support member furthermore may be shaped like a tube to retain a compressible surface that may be formed on the periphery of the base, further positioning and securing the bulb. The support member and stop are dimensioned so that the cover is positioned on the flange, and the bulb is positioned so that it is positioned at a predetermined height relative to the top of the cover. Furthermore, the support member cross-section permits the bulb quick connect terminals to pass through the support member during installation and de-installation.

The above, and other objects, features and advantages of the present invention will become apparent from the following description read in conjunction with the accompanying drawings, in which like reference numerals designate the same elements.

BRIEF DESCRIPTION OF THE DRAWINGS

For a better understanding of these and other objects of the present invention, reference will be made to the following detailed description of the invention which is to be read in association with the accompanying drawings, wherein.

DESCRIPTION OF THE INVENTION

Figure 1:
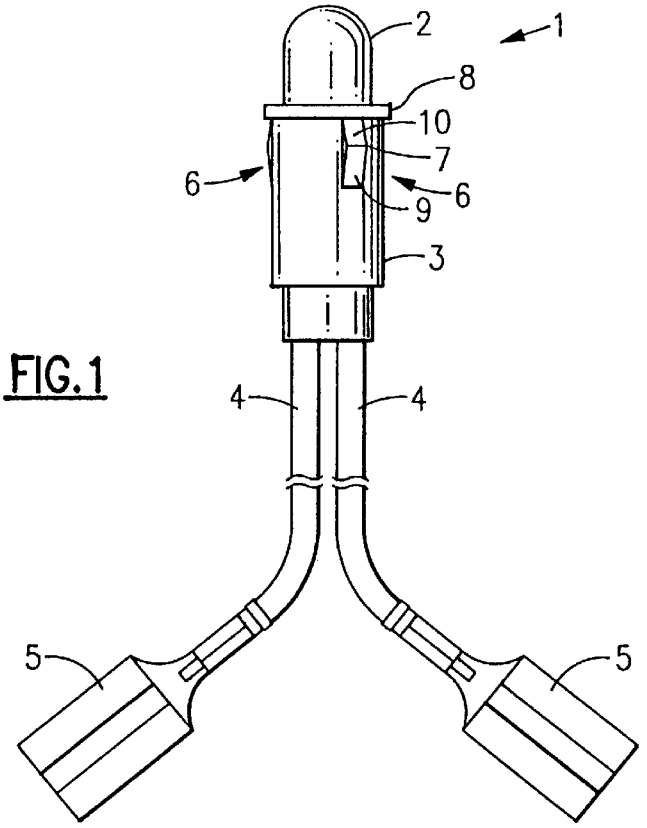
FIG. 1 is a side view of a conventional lamp that includes a bulb, a base, and a locking surface implemented as a two-sided ramp.
Figure 2:
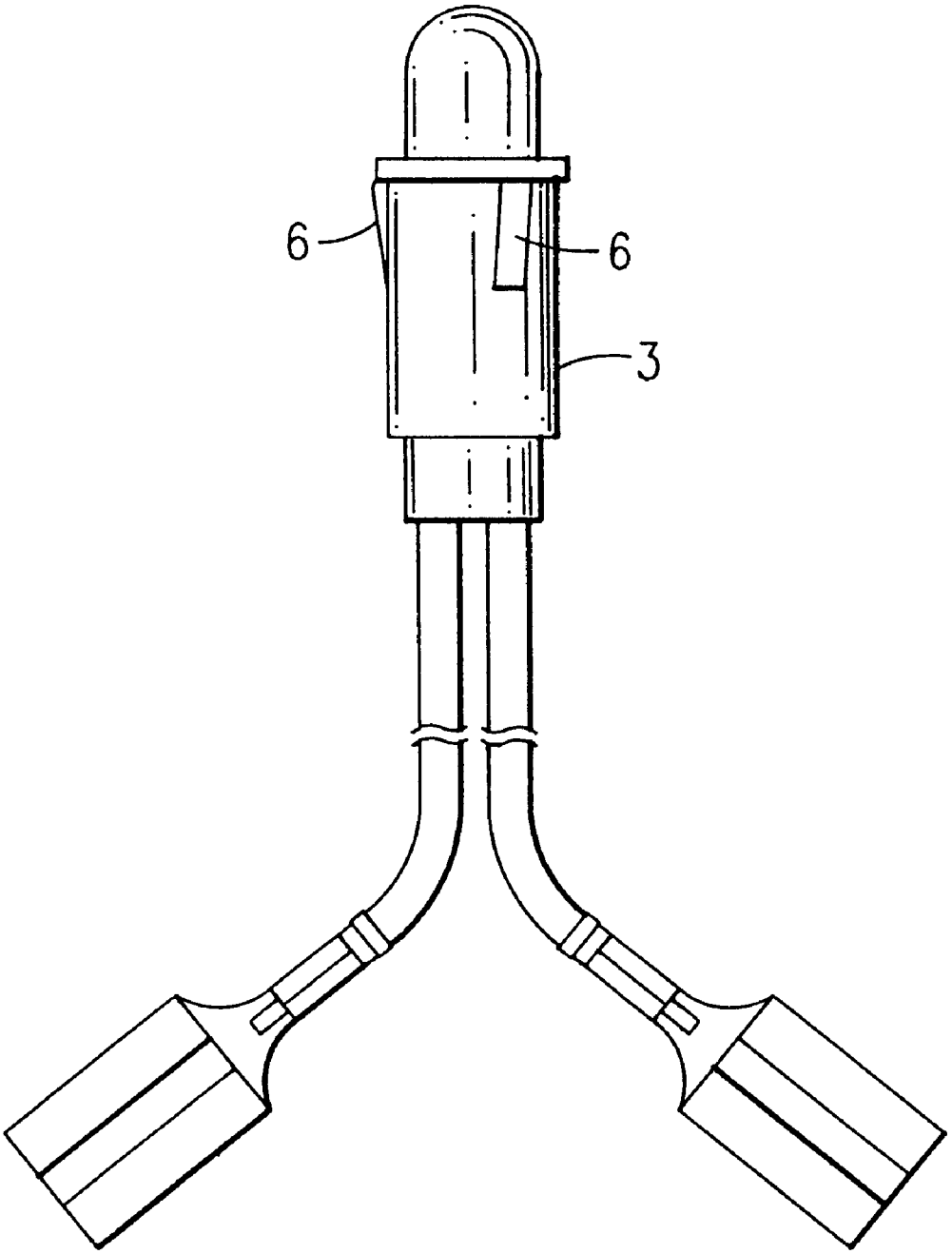
FIG.2 Prior Art
FIG. 2 is a side view of a conventional lamp that includes a bulb, a base, and a locking surface implemented as a tongue.

Referring to FIG. 1, there is shown a conventional light emitting diode lamp, generally referenced 1, comprising a LED 2 mounted in a base 3, and a pair of electrical leads 4 providing a voltage to the LED 2, each lead 4 connected to an electrical terminal 5. The terminals 5 are portrayed here as quick connect terminals. Around the perimeter of the housing 3 is at least one resilient and compressible support surface 6 for securing the lamp 1. Each support surface 6 conventionally ramps up along a ramp 9 from base 3 to a point of maximum projection 7, and ramps down along a ramp 10 toward a flange 8 end, at a steeper slope than the ramp up. As a ramp, each support surface compresses by a compaction of its constituting material. Alternatively, referring to FIG. 2, each support surface 6 may be formed as a tongue that ramps up from its base toward a tip spaced near the flange end of the base 3. As a tongue, each support surface compresses by a bending of its shape.

Figure 3:
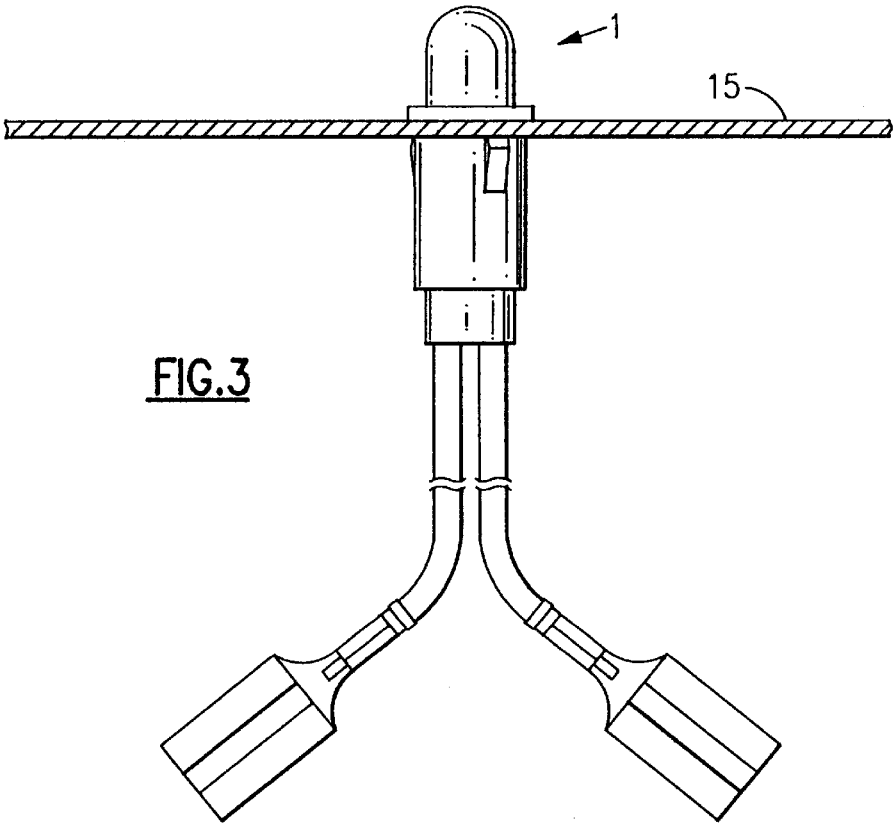
FIG. 3 is a cross sectional view of a lamp mounted on a panel.

Referring to FIG. 3, there is shown the light emitting diode lamp 1 conventionally mounted in and supported by a cutaway panel 15. In practice, an installer positions the bottom of the lamp 1 through a panel hole (not shown). The panel hole is sized so that it accommodates the cross-section of the base 3, accommodates the support ramp surfaces 6 only in a compressed shape, and does not accommodate the flange 8. Thus, the base 3 is inserted into the panel hole through its terminal end, and through the support surface(s) 6 so that the flange 8 rests against the panel 15 and the steep slope of the ramp 10 locks the flange 8 against the panel 15, consequently locking the lamp 1 against panel 15.

Figure 4:
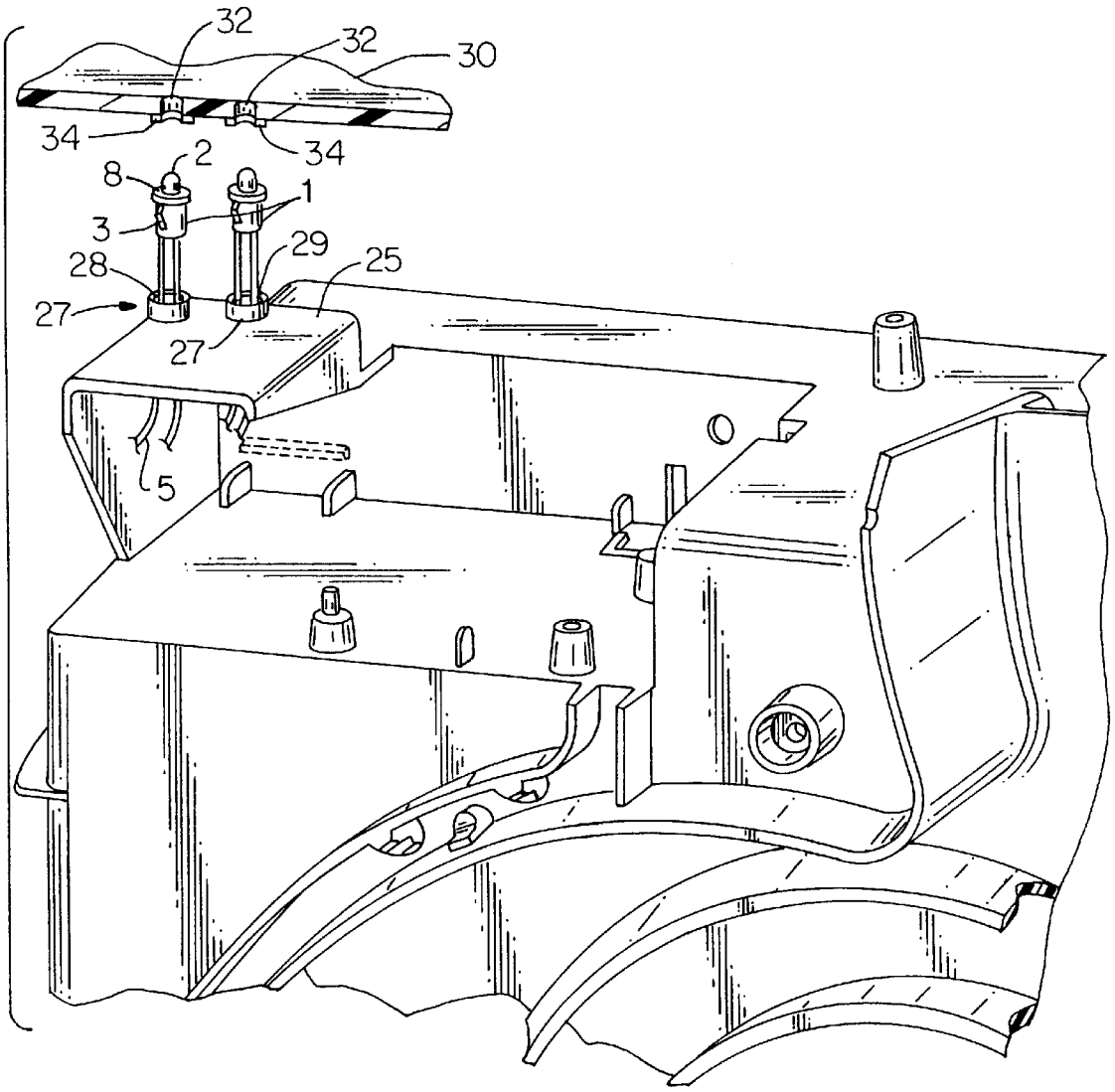
FIG. 4 is a perspective view of an air handling equipment appliance that includes a support wall that supports a boss shaped support member for supporting a lamp on a retaining surface, and an exploded cover that presses down upon the lamp flanges, retaining the lamp on the retaining surface.

Referring to FIG. 4, an air handling equipment apparatus support wall 25 of the invention includes boss support members 27 for accommodating lamps 1. The lamps 1 include a bulb 2 that is preferably a LED. In the air handling equipment apparatus, the lamps 1 function as indicator lights, displaying by their luminance or lack thereof, a variety of apparatus statuses, e.g. whether or not an apparatus fan is in operation, or whether or not an apparatus filter requires a replacement. The indicator lights are connected via their terminals 5, here quick connect terminals (not shown), to the equipment apparatus control circuitry (not shown), located contiguously to the support wall 25 and the support member 27. Each support member 27 accommodates, in assembly, a lamp base 3, with the base flange 8 that rests on a retaining surface 28 of the support member 27. An air handling equipment cover 30, having a separate opening 32 for accommodating in assembly each LED, is formed with a bottom surfaces 34 that presses down upon the lamp flanges 8, and thus supports and positions each lamp 1 on the support wall 25, without requiring a conventional panel mount Additionally, the support member interior wall 29 is tubular shaped and sized to press against any retaining resilient surface (not shown) the lamp may have, to further secure and position the lamp on the apparatus support wall. The retaining surfaces 28 supporting the lamp 1 on a flange 8. The depth of each retaining surface 28, and cover combination cooperatively define the vertical position of the LED, and the extent that the top of each LED is alternatively below or above the cover top surface. Preferably, the cover substantially encompasses each LED so that each LED is protected from environmental contact, and the light emanating from each LED is viewable from relevant angles.

To remove each lamp 1 from the apparatus, the apparatus cover is lifted and the lamp 1 is simply urged from its respective support member. The LEDs, while being securely and precisely positioned in the apparatus, are neither locked in position nor attached to the apparatus.

Figure 5:
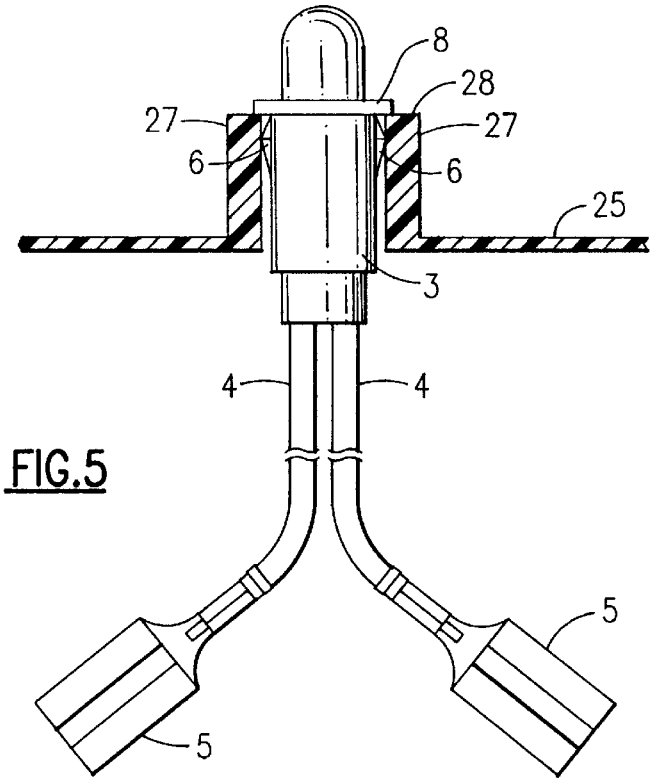
FIG. 5 is a cross sectional view of the appliance support wall and boss shaped retaining member, with compressible lamp support surfaces pressing against the interior wall of the retaining member, wherein the lamp flange is supported by the retaining surface, and the inner wall of the support member and retains the lamp base in position.

In greater detail and referring to FIG. 5, an apparatus support wall 25 portrayed in cross-section includes a cylindrical support member 27 preferably enclosing the lamp base 3, with the lamp housing flange 8 resting on the retaining surface 28 of the support member 27. The support member 27 cross-section is tubularly shaped and sized to accommodate the lamp base 3 tubular portion, but not the flange 8, and the support surfaces 6, if any, portrayed here as a compressed ramp. However, the support member cross-section is sized to accommodate the support surfaces 6 when they are compressed. The electrical terminals 5, electrical leads 4, and support member 27 cross section are sized so that the cross section accommodates the electrical leads 4 and electrical terminals 5. Accordingly, an installer positions the electrical leads 4 and electrical terminals 5 and the bottom of the lamp 1 through the retaining surface hole. When the interior wall of the support member 27 encounters each support surface 6, the support surface 6 compresses to the cross-section of the support member interior cross-section, and the installer pushes the lamp down against the support member until the lamp flange 8 rests on the retaining surface 28, with the support surfaces 6 pressing against the inner wall of the boss 27, consequently resting and securing the position of the lamp against the support member 27.

Figure 6:
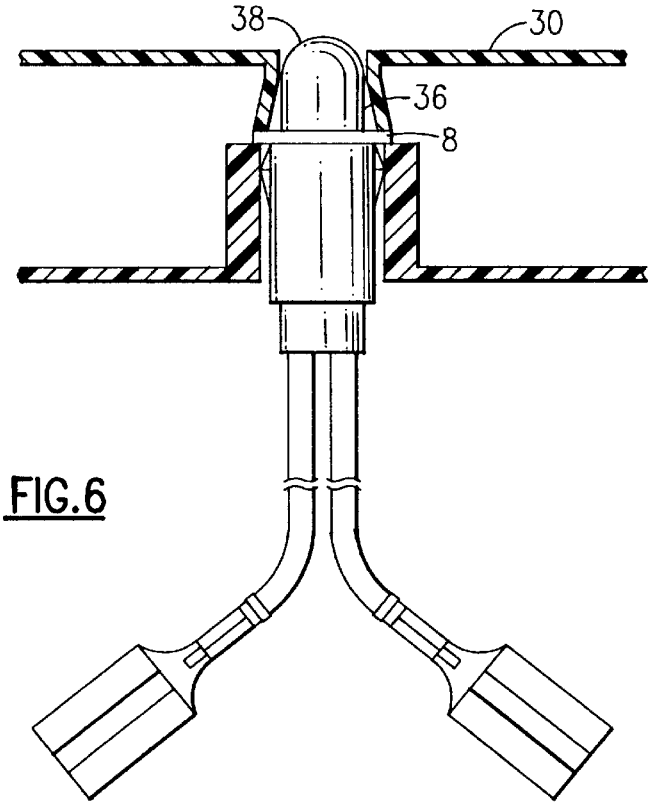
FIG. 6 is a cross sectional view of the appliance support wall and boss shaped retaining member, wherein the lamp flange is supported by the retaining surface, and the appliance top cover presses on the lamp flange, securing and positioning the flange on the retaining surface, with the inner wall of the support member additionally retaining the lamp base in position.

Referring to FIG. 6, a lamp 1 that has been installed on a support member 28, is pressed down by an installed air handling equipment apparatus cover 30, that applies a securing and positioning pressure against each lamp flange 8. Because the cover 30 may be hinged and rotationally install over the support wall 28, the cover bottom opening 36 include a greater cross sectional area than the cover top opening 38.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

We claim:

1. An air handling equipment apparatus mounting and restraining device for an indicator lamp that includes in combination:

a lamp having a base containing a radially expanded top flange, and a contoured bulb mounted on the top of said base;

an air handling apparatus support member having a hole passing therethrough for slidably receiving the base of the lamp, so that the lamp flange rests on a retaining surface surrounding said hole to secure said lamp in said support member;

a cover mounted over the top surface of the support member having a contoured opening passing therethrough for receiving said bulb therein, said cover pressing against said lamp flange to secure said flange against said retaining surface of said support member.

2. The device of claim 1 wherein each cover opening has a larger cross-section on said bottom side than on said top side, wherein said bottom cross-section accommodates its respective LED when said cover is angled over said LED.

3. The device of claim 1 wherein said support member includes a tubular housing for receiving said lamp base, said lamp base includes at least one side support surface means for pressing against said tubular housing, and wherein said tubular housing secures said lamp base relative to said support member by said support surface pressing against said housing.

4. The device of claim 3 wherein said support surface comprises a nylon material.

5. The device of claim 3 wherein said support surface is formed as at least one of a ramp surface and a tongue.

6. The device of claim 1 wherein said support member is disposed on an air handling equipment apparatus support wall; said retaining surface is disposed a predetermined distance above said apparatus support wall; said cover top side is disposed above said flange a predetermined distance above said flange; and wherein said bulb is disposed a predetermined distance relative to said cover top.

7. The device of claim 1 wherein said base is a panel-mount housing.

8. The device of claim 1 wherein said lamp includes at least one exterior electrical lead each having an electrical terminal, and each electrical terminal and lead sized relative to said hole so that said hole accommodates said lead and terminal.

9. The device of claim 8 wherein said terminal is an electrical quick-connect.

10. The device of claim 1 wherein said bulb is a LED.

11. An appliance indicator lamp apparatus for at least one lamp, comprising:

a lamp having a bulb, a base for said bulb including an exterior wall having a cross-sectional shape, at least one outer projecting surface from said exterior wall having a projection that compresses resiliently, and a lip on said housing extending beyond said exterior wall for at least a portion of said exterior wall, wherein said bulb LED is positioned on said base;

an appliance wall that includes a cylindrical boss for each lamp, and an opening in said appliance wall below each boss, each boss having an interior wall sized to be greater than said housing exterior wall, and less than said flange cross-section, and having a predetermined height above said apparatus wall, wherein said housing fits within said boss interior wall, said projecting surface compresses, pressing against said boss interior wall so that said housing exterior wall retains said lamp within said boss, said flange rests on said boss, and said bulb rests on said housing a predetermined distance above said appliance wall, and said lamp may be urged from said boss; and an appliance top cover that closes over said appliance wall, said cover having a top side and a bottom side, a separate cover opening for each of said bulbs wherein each cover opening is sized to accommodate its respective bulb, and an at least one lamp holding surface disposed on said bottom side, each lamp holding surface resting on a flange of said housing and each flange having a holding surface resting on it, wherein each lamp is retained in a boss by said holding surfaces, and said top side rests above said flange a predetermined distance from said flange, wherein said LED is displaced a predetermined distance relative to said cover top.

12. The apparatus of claim 11 wherein each cover opening has a taper wherein the cover opening bottom side cross-section is greater than the cover opening top side cross-section, whereby said hole surrounds its respective bulb when said cover is angled over said bulb.

13. The apparatus of claim 11 wherein said base comprises a nylon material.

14. The apparatus of claim 11 wherein said outer projecting surface comprises a nylon material.

15. The apparatus of claim 11 wherein said outer projecting surface is formed of at least one of a ramp surface and a tongue surface.

16. The apparatus of claim 11 wherein said bulb is substantially enclosed by a respective cover opening.

17. The apparatus of claim 11 wherein said housing is a panel-mount housing.

18. The apparatus of claim 11 wherein each lamp includes at least one exterior electrical lead each having an electrical terminal, and each electrical terminal and each lead is sized smaller than said respective boss so that said respective boss accommodates said respective leads and terminals.

19. The apparatus of claim 18 wherein said terminal is an electrical quick-connect.

20. The apparatus of claim 11 wherein said bulb is an LED.

* * * * *